United States Patent [19]

Mattheis et al.

[11] 4,098,430

[45] Jul. 4, 1978

[54] PLASTIC CONTAINER

[75] Inventors: Harley H. Mattheis, Verona, N.J.; Edward J. Potter, Madison, Ohio

[73] Assignee: Ethyl Development Corporation, Baton Rouge, La.

[21] Appl. No.: 685,290

[22] Filed: May 11, 1976

Related U.S. Application Data

[63] Continuation of Ser. No. 543,659, Jan. 24, 1975, abandoned, which is a continuation of Ser. No. 400,730, Sep. 26, 1973, abandoned.

[51] Int. Cl.[2] ..... B65D 43/16; B65D 51/04

[52] U.S. Cl. ..... 220/339; 220/283; 220/306

[58] Field of Search ..... 220/339, 337, 315, 306, 220/283

[56] References Cited

U.S. PATENT DOCUMENTS

| | | | |
|---|---|---|---|
| 2,906,428 | 9/1959 | Fralick | 220/283 |
| 3,381,850 | 5/1968 | Haugen | 220/337 X |
| 3,616,487 | 11/1971 | Dearth | 220/337 X |
| 3,894,655 | 7/1975 | Mattheis et al. | 220/283 |
| 3,968,880 | 7/1976 | Ostrowsky | 220/339 X |

*Primary Examiner*—William Price
*Assistant Examiner*—Steven M. Pollard
*Attorney, Agent, or Firm*—John F. Sieberth; Donald L. Johnson; Edgar E. Spielman, Jr.

[57] ABSTRACT

An integrally formed, one-piece, generally rectangular, plastic container particularly adapted for holding medicines is disclosed. The container includes a generally rectangular bottom section which is connected to a rectangular top section by means of an integrally formed, flexible, plastic hinge at the rear of the two sections. In the closed position, the top section overlies the bottom section and latch means lock the two sections together. The closed container requires that equal pressure be applied to the rear corners thereof in order to disengage the latch means. The container provides a substantially childproof safety closure for tableted medicines such as aspirin, laxatives, cold tablets, prescription drugs, etc.

4 Claims, 23 Drawing Figures

FIG. 4C.
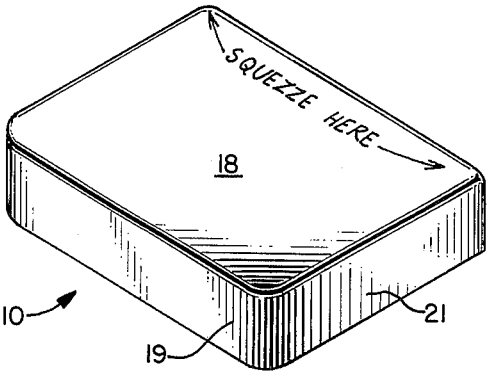
FIG. 1.
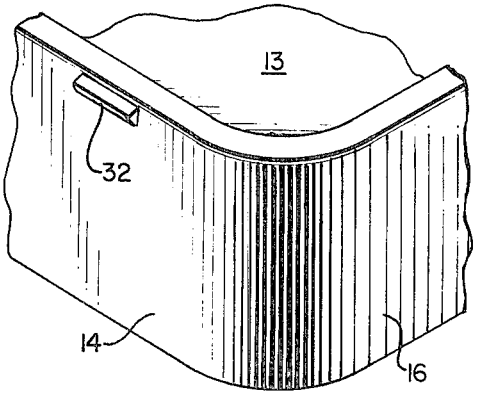
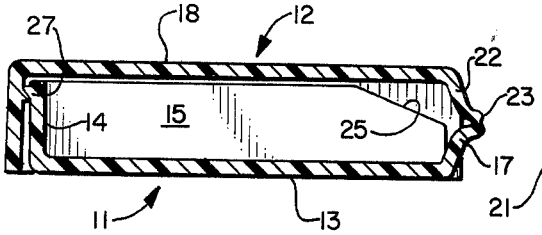
FIG. 5A.
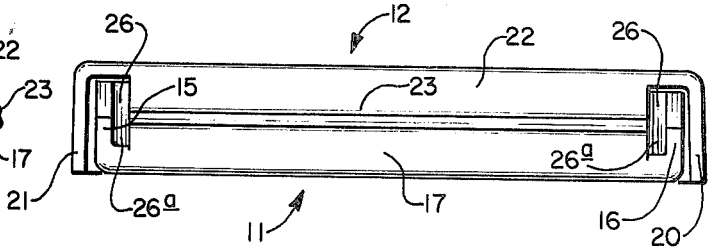
FIG. 2.
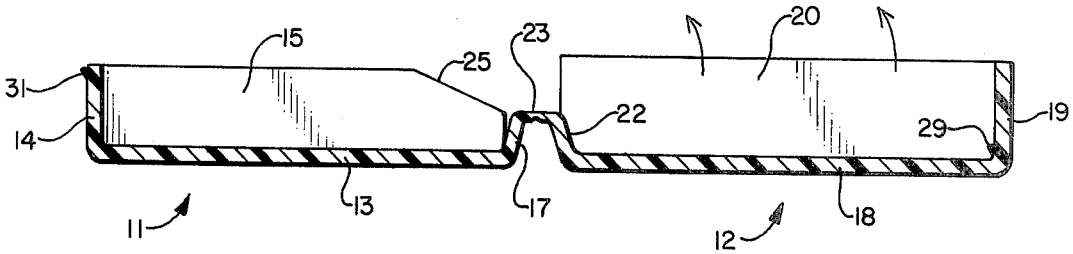
FIG. 4A.
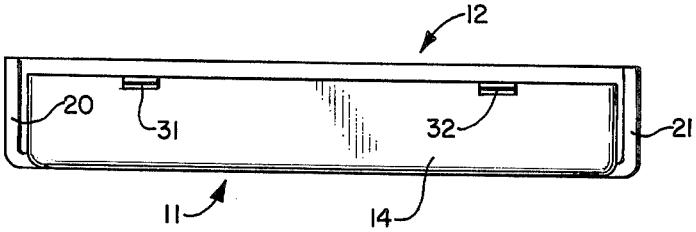
FIG. 3.
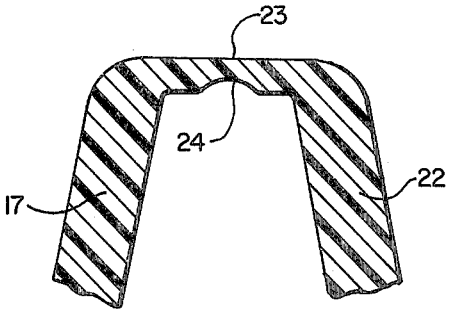
FIG. 4B.

PLASTIC CONTAINER

CROSS-REFERENCE TO RELATED APPLICATION

This is a continuation of application Ser. No. 543,659, filed Jan. 24, 1975 now abandoned which is a continuation of Ser. No. 400,730 filed Sept. 26, 1973, now abandoned.

BACKGROUND OF THE INVENTION

1. Field of the Invention

This invention relates to a one-piece, integrally formed, generally rectangular, plastic box particularly suited for packaging medicines.

2. Description of the Prior Art

Many medicines such as aspirin have conventionally been packaged in generally rectangular, two-piece, metal containers having a top rectangular section which is hingedly connected to a rectangular bottom section. Earlier boxes utilized a conventional pinned hinge arrangement at the rear thereof to join the two components together. More recent two-piece boxes are connected by means of matching projections and recesses provided on each sidewall of the box slightly forward of the rear thereof (see U.S. Pat. No. 2,906,428). These boxes are opened by applying pressure to the rear of the box.

Recent FDA regulations will require that aspirin tablets and a number of items be packaged in special containers which have "childproof" features. These containers must not be openable by children under a certain age in a certain number of attempts to open the containers. Satisfactory closures have been developed for bottle-type containers for aspirin and prescription drugs and other items which may be potentially dangerous to children. However, difficulty has been encountered in producing a satisfactory rectangular, two-piece, hinged, conventional container for packaging tablets. The problem has primarily been one of developing a container which has a consistent opening pressure, such that only pressure applied by an adult can open the container. Erratic opening pressures utilizing the conventional engaging means for the closure, i.e., the projection on the front of the lower portion of the container which is engaged in a recess in the front wall of the upper portion of the container, together with the difficulty in producing the recesses and protrusions which form the hinge mechanism of the container, have prevented the conventional metal tablet box from qualifying as a childproof container.

The present invention overcomes numerous disadvantages of previously used containers in that it can be readily prepared by utilization of flexible plastic materials and has reproducible opening and closing characteristics rendering it eminently suitable for use in packaging medicines.

SUMMARY OF THE INVENTION

It is an object of the present invention to provide an integrally formed, plastic container suitable for holding tablets.

It is another object of the present invention to provide an integrally formed, plastic container having reproducible opening characteristics.

It is still another object of the present invention to provide an integrally formed, plastic container which can qualify for certification as "childproof".

It is a still further object of the present invention to provide an injection molded, plastic container having two components joined by a "living hinge".

The foregoing objects and other advantages that are brought out hereinafter are realized in the container of the present invention in an integrally formed, one-piece plastic container which has a generally rectangular bottom section having a planar bottom wall, two opposed, upturned sidewalls, and an upturned front wall, all of which are integrally formed and connected to each other, and an upturned back wall which is integrally formed and connected to the bottom wall. A generally rectangular top section has a planar top wall, two opposed, downturned sidewalls, and a downturned front wall, all of which are integrally formed and connected to each other, and a downturned back wall integrally formed and connected to the top wall. Integrally formed hinge means are provided which connect the back wall of the top section to the back wall of the bottom section. The top section is adapted to overlie the bottom section and to be frictionally engaged therewith when the container is in the closed position. An alternative and preferred embodiment of this invention features a container as described above except that the upturned back wall of the bottom section is integrally formed and connected to the planar bottom wall, the upturned front wall and the two opposed sidewalls.

The present invention provides many advantages over those containers previously utilized for packaging medicants such as aspirin. The present container is readily formed of plastic material such as medium, low or high density polyethylene, polypropylene, or other semi-rigid plastic materials which can be readily injection molded. The device can be produced by preferably injection molding these thermoplastics to produce an integrally formed container having two rectangular compartments connected by a living hinge. The present container has reproducible opening characteristics which will qualify it as a childproof container.

BRIEF DESCRIPTION OF THE DRAWINGS

FIG. 1 is a perspective, elevational view of a container of the present invention showing the container in a closed position;

FIG. 2 is a rear view of the container shown in FIG. 1;

FIG. 3 is a front, elevational view of the container as shown in FIG. 4;

FIG. 4A is a cross-sectional view of the container of FIG. 4 along the line 4A—4A;

FIG. 4B is a broken, enlarged view of the hinge portion of the container as shown in FIG. 4A;

FIG. 4C is a broken, enlarged, perspective view of a forward corner of the lower section of the container as seen in FIG. 3;

FIG. 5A is a cross-sectional view of the container of FIG. 5 taken along line 5A—5A;

DESCRIPTION OF THE PREFERRED EMBODIMENTS

Figure 4:
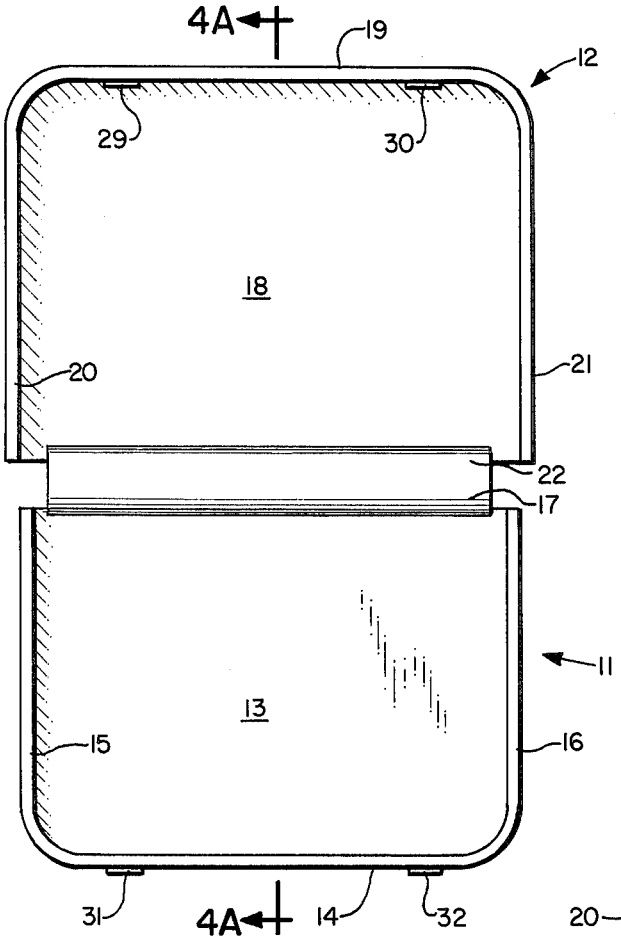
FIG. 4 is a top plan view of the container of the present invention in the open position.

Referring now to FIGS. 1–5, 4A and 5A, a container of the present invention is characterized in that it is made from one integrally formed piece of semi-flexible plastic material. The container, designated generally by the reference numeral 10, features two sections—a bottom section, designated generally by the numeral 11, and a top section, designated generally by the numeral 12. The bottom section includes a generally rectangular planar bottom wall 13 which is integrally connected to an upturned front wall 14. The front wall 14 and the bottom wall 13 are integrally formed with and connected to opposed, upturned sidewalls 15 and 16. The bottom section has a rear wall 17 which is integrally formed with and projects upward at a slight angle from the bottom wall 13. The rear wall 17 is slightly less than one-half of the height of the front wall and sidewalls of the bottom section.

The top section 12 of the container includes a generally planar top wall 18 which is integrally formed with and connected to a downturned (in the closed position) front wall 19. The top wall 18 and front wall 19 are integrally formed with and connected to two opposed downturned sidewalls 20 and 21. Top wall 18 has integrally formed therewith a downwardly and rearwardly projecting rear wall 22. This illustrated container optionally features front wall 19 and two opposed downturned sidewalls 20 and 21 having a height which is greater than the height of front wall 14 and upturned sidewalls 15 and 16 by an amount slightly exceeding the thickness of bottom wall 13. By the above-mentioned walls of the top section having a greater height than the above-mentioned walls of the bottom section, it is clearly seen in FIG. 5A that upon closing the container the bottom periphery of top section 12 formed by the bottom portion of front wall 19 and opposed downturned sidewalls 20 and 21 is flush with the bottom surface of bottom wall 13.

Figure 4D:
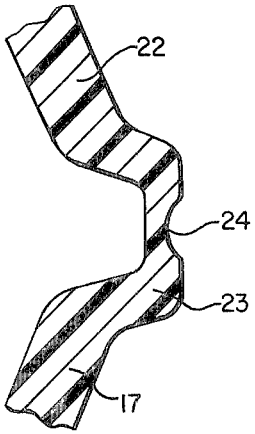
FIG. 4D is an enlarged, broken view of the hinge portion of the container shown in FIG. 5A.
Figure 4E:
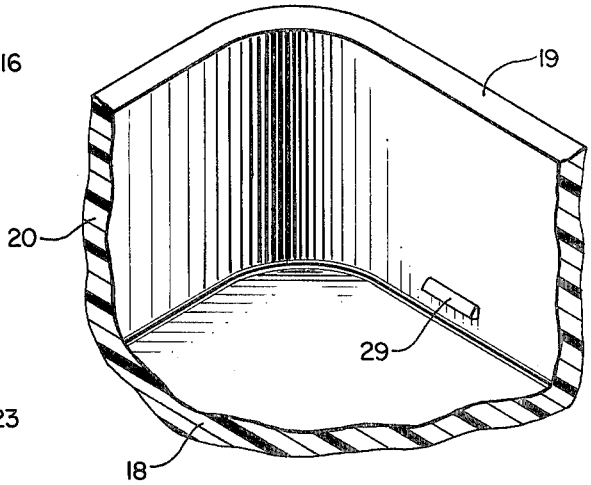
FIG. 4E is a broken, elevational, perspective view of an inside corner of the top portion of the container as seen in FIG. 4.
Figure 5:
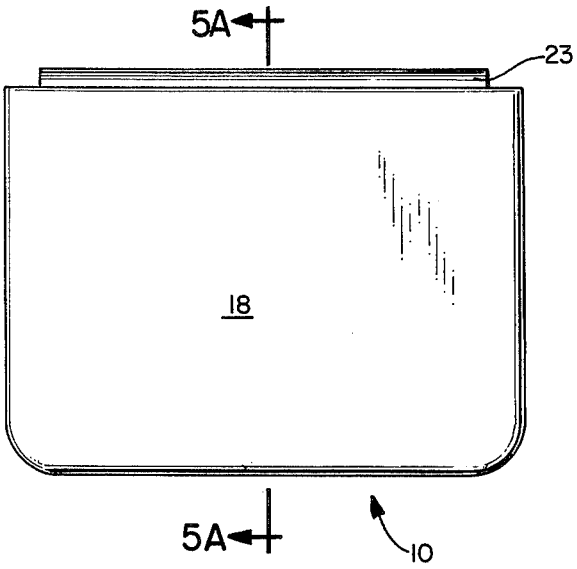
FIG. 5 is a top plan view of the container of the present invention shown in the closed position.

The rear walls 22 and 17 are joined by an integrally formed living hinge section 23. As seen more clearly in FIGS. 4B and 4D, the hinge section 23 has a wall thickness which is substantially thinner than the wall thickness of the rear walls 22 and 17. Preferably, the wall thickness of the hinge section is about one-half or less of the thickness of the rear walls 17 and 22. The longitudinally extending hinge element 23 is provided with a longitudinally extending groove 24 (which may be in any particular form, but is shown in the drawings as a semi-circular groove). The groove provides a weakening of the major flexing portion of the hinge element 23 to facilitate easy flexure of the hinge element 23 when opening and closing the container.

Referring now to FIGS. 2, 4A and 5A, it can be seen that the bottom section 11 of the container has its sidewalls 15 and 16 provided with a rearwardly tapered section 25 which permits the top wall 18 to be flexed downward by application of thumb pressure to the rearward corners thereof (see the "SQUEEZE HERE" indication in FIG. 1) to activate the latching means as will be hereinafter described. As seen more clearly in FIG. 2, the sidewalls 20 and 21 of the upper section of the container terminate at the rear end of the container and are separated from (i.e., not integrally connected to) the rear wall 22 by means of generally rectangular openings 26—26 on each side thereof. The rear wall 17 of the bottom section is also separated by a small slot or rectangular space **26*a* from the sidewalls 15 and 16. The width of the gaps 26 and 26*a* in the rear of the container, together with the slope of the wall portion 25 of the sidewalls, can be suitably adjusted to provide proper flexing of the top corner areas of the top cover 12** to achieve the proper flexure of the cover to produce the release of the top and bottom portions of the container.

Figure 4F:
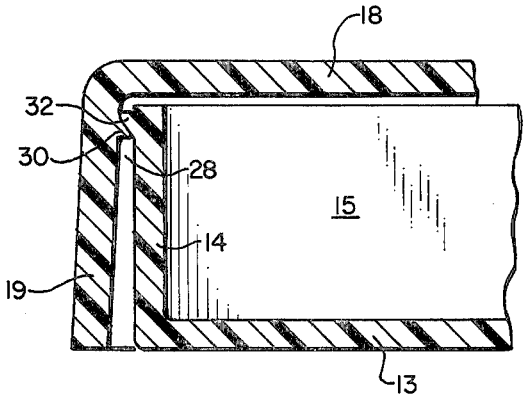
FIG. 4F is an enlarged, broken, sectional view of the forward portion of the container of FIG. 5A showing the details of the engagement of the latch means.
Figure 6:
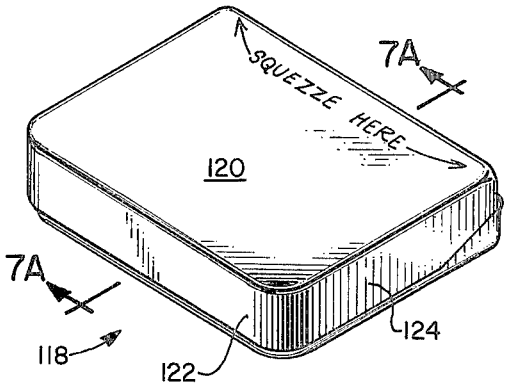
FIG. 6 is a perspective, elevational view of another container of the present invention showing the container in a closed position.

Referring now to FIGS. 3, 4, 4A and 4F, the upper or top section of the container 12 and the bottom or lower section 11 of the container are held in the closed position, as seen in FIGS. 1, 4F, 5 and 5A, by means of a left latch 27 and a right latch 28. Each latch includes an integrally formed, short, longitudinally extending protrusion 29 on the left-hand side of the inside wall of the front wall 19 of the top section 11 of the container and another protrusion 30 on the right-hand side of the inside wall of the top section of the container. The two top protrusions 29 and 30 are adapted to engage and interlock with like left-hand protrusion 31 and right-hand protrusion 32 which are integrally formed with and project from the upper edge of the outside wall of the front wall 14 of the lower section of the container. As seen more clearly in FIG. 4F, when the top section of the container is folded over and pressed downwardly over the bottom section of the container, the two sections are latched together by engagement of the respective left- and righthand protrusions on the top section and bottom section of the container. While the protrusions on each section of the container are shown in FIG. 4F with sloping engaging walls, the protrusions may have transverse walls on the engaging surfaces, if desired.

Illustrated in FIGS. 6–15 is another container of the present invention. The container illustrated in these drawings is very similar to the prior-described container. Differences in the container illustrated in FIG. 6 et seq and the prior-described container are that the present container has a bottom section which features an integrally formed bottom wall, front wall, two upturned sidewalls and an upturned back wall, all of which are integrally formed and connected one to the other; and features a container having sidewalls and front walls for the top and bottom section which are of equal height. Another feature includes different latch means. It is to be understood that the latch means of the first-described container may be utilized on the present container or vice versa.

Referring now to FIGS. 6–9, 11 and 12, a second container of the present invention that is made from one integrally formed piece of semi-flexible plastic material is illustrated. The container, generally designated by the numeral 118, features a top section generally designated by the numeral 102 and a bottom section generally designated by the numeral 104. The top section and the bottom section are connected by hinge section 140. The bottom section includes the generally rectangular bottom wall 132 which is integrally connected to an upturned front wall 138, two upturned opposed sidewalls 130 and **130*a* and an upturned rear wall 134. The rear wall 134** is slightly less than one-half the height of the front wall and sidewalls of the bottom section.

Top section 102 is formed by planar top wall 120 which is integrally formed with and connected to a downturned (in the closed position) front wall 122 and to two opposed downturned sidewalls 124 and **124*a* along with a downturned rear wall 136 which is integrally formed with and connected to planar top wall 120. Downturned rear wall 136 projects rearwardly and downwardly from top wall 120. In this illustrated embodiment the front wall 122 and two opposed, downturned sidewalls 124 and 124*a* have a height which is substantially equal to the height of upturned front wall 138 and upturned, opposed sidewalls 130 and 130*a***. By having these walls of equal height the placing of indicia on the top and bottom wall of the container utilizing normal manufacturing techniques will be made easier as the container may be placed in the open position with the top and bottom walls facing upward without there being any rocking of the open container as the indicia is placed on the top or bottom walls.

The rear walls 134 and 136 are joined by an integrally formed living hinge 140. As seen more clearly in FIGS. 10 and 15, the hinge section 140 has a wall thickness which is substantially thinner than the wall thickness of rear walls 134 and 136. Preferably the wall thickness of the hinge section is about one-half or less the thickness of the rear walls 134 and 136. Longitudinally extending hinge element 140 is provided with a longitudinally extending groove 162 (which may be in any particular form, but is shown in the drawings as a semi-circular groove). The groove provides a weakening of the major flexing portion of the hinge element 140 to facilitate easy flexure of the hinge element when opening and closing the container.

Figure 7A:
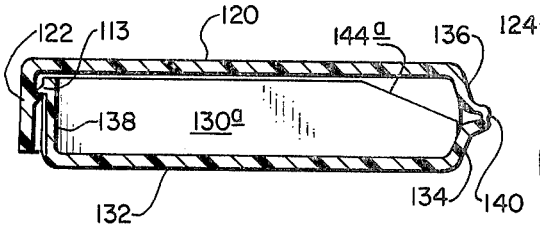
FIG. 7A is a sectional view along lines 7A—7A of FIG. 1.
Figure 7:
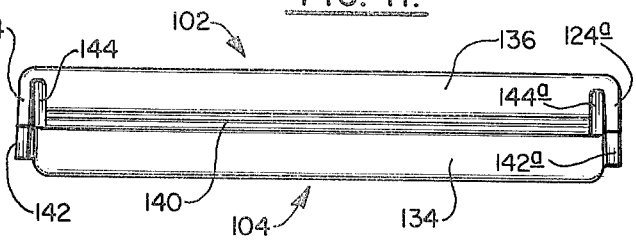
FIG. 7 is a rear view of the container shown in FIG. 6.
Figure 8:
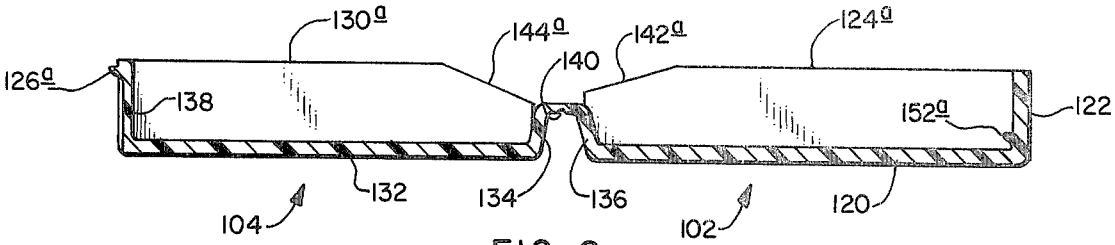
FIG. 8 is a sectional view taken along section lines 8—8 in FIG. 12.
Figure 9:
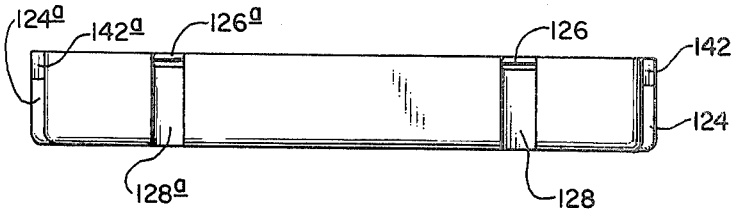
FIG. 9 is a front, elevational view of the container shown in FIG. 12.
Figure 10:
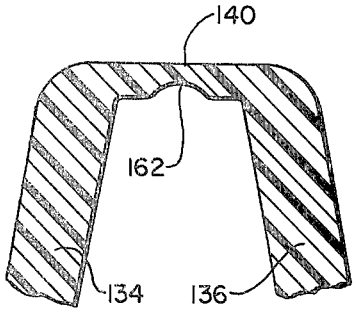
FIG. 10 is a broken, enlarged view of the hinge portion of the container as shown in FIG. 8.
Figure 12:
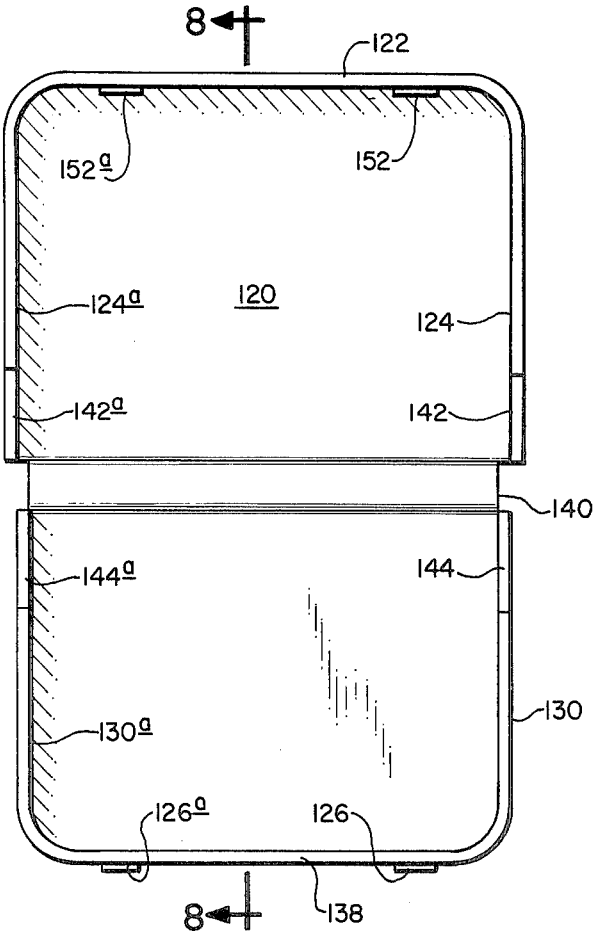
FIG. 12 is a top plan view of the container shown in FIG. 6 in the open position.

Referring now to FIGS. 7, 7A and 8, it can be seen that both bottom section 104 and top section 102 have sidewalls which are provided with rearwardly tapered sections, which sections are designated by the numerals 144 and **144*a*, for upturned sidewalls 130 and 130*a* respectively, and by the numerals 142 and 142*a* for the downwardly opposed sidewalls 124 and 124*a* respectively. These rearwardly tapered sections facilitate the downward flexing of top wall 120 by application of thumb pressure to the rearward corners of top wall 120 (see the "SQUEEZE HERE" indication in FIG. 6). The downward flexing of top wall 120 acts to activate the latching means as will be hereinafter described. As is the case for the first-described container of this invention, downturned sidewalls 124 and 124*a* terminate at the rear end of the container and are separated from (i.e., not integrally connected to) downturned rear wall 136 by means of generally rectangular openings on each side thereof. As can be seen from the drawings, these rectangular openings or slots are not as wide as the slots for the first-described container of this invention. In fact, the slots of the present container are of a width which is approximately equal to the thickness of upturned sidewalls 130 and 130*a*. By having the slots this width it can be seen that upturned sidewalls 130 and 130*a* are free to intersect such slots when top wall 120 is pushed forward by downward pressure on the rear corners thereof. It should also be noted that the present container differs from the before-described container in that no slots are present in the bottom section. In other words, rear upturned wall 134 is integrally connected to opposed upturned sidewalls 130 and 130*a* and bottom wall 132**.

Figure 13:
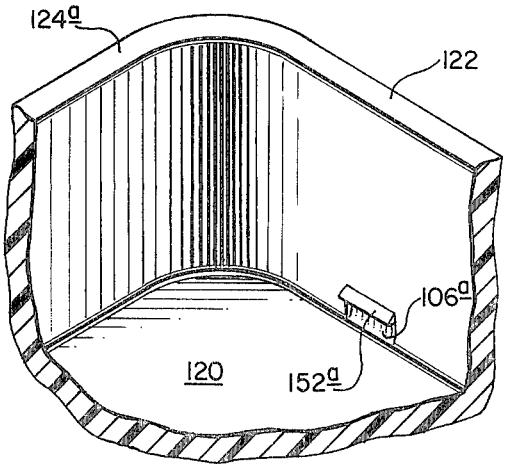
FIG. 13 is a broken, elevational, perspective view of an inside corner of the top portion of the container shown in FIG. 8.
Figure 15:
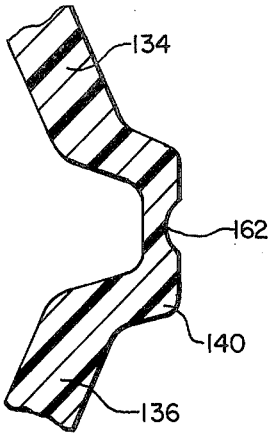
FIG. 15 is an enlarged, broken view of the hinge portion of the container shown in FIG. 7A.
Figure 14:
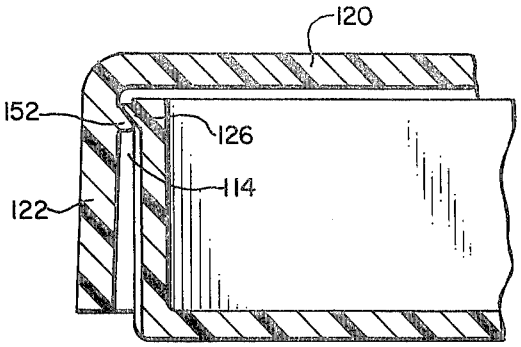
FIG. 14 is an enlarged, broken view of the forward portion of the container as shown in FIG. 7A to show the details of the engagement of the latch means.

Referring now to FIGS. 11, 7A, 8 and 12–14, it can been seen that the upper or top section 102 of the container and the bottom or lower section 104 of the container are held in a closed position by means of a left latch 113 and a right latch 114. Each latch includes an integrally formed, short, longitudinally extending protrusion 152 on the right-hand side of the inside wall of the front wall 122 and another protrusion **152*a* on the lefthand side of the inside wall of front wall 122. The top protrusions 152 and 152*a* are adapted to engage and interlock with like right-hand protrusion 126 and left-hand protrusion 126*a* which are integrally formed with and project from the upper edge of the outside wall of front wall 138 of the lower section of the container. As can be seen more clearly in FIG. 4F, when the top section of the container is folded over and pressed downwardly over the bottom section of the container, the two sections are latched together by engagement of the respective left- and right-hand protrusions on the top section and bottom section of the container. While the protrusions on each section of the container as shown in FIG. 14** with sloping engaging walls, the protrusions may have transverse walls and engaging surfaces, if desired.

Figure 11:
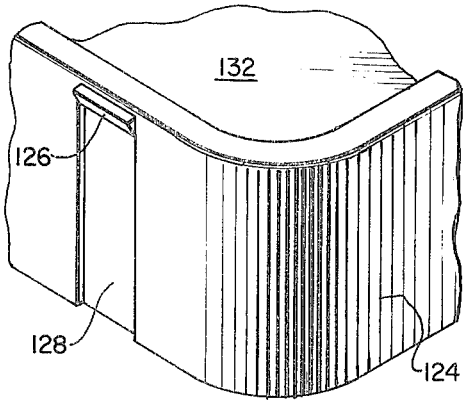
FIG. 11 is a broken, enlarged, perspective view of a forward corner of the lower section of the container as seen in FIG. 9.

As can be seen in FIG. 11, recesses 128 and **128*a* are contiguous to and downwardly extending from protrusions 126 and 126*a*. Recesses 128 and 128*a* are optional. Beneath protrusions 152 and 152*a*, as shown in FIG. 13, are recesses 106 and 106*a*** respectively. All of these recesses act to give more depth to the latching protruberances without requiring the protruberances to extend as far from the walls to which they are attached to achieve similar depth without the recesses. These recesses may be utilized in the prior-described container as well as the present container.

In order to open the closed container, an adult will take the container in both hands and position the left- and right-hand rear corners of the box between the thumb and forefinger of the left and right hands and apply a combination of downward and forward pressure by the thumbs. This will tend to do two things—distort the upper cover to bow the front wall outwardly thereby assisting in releasing the left- and right-hand latches; the forward pressure component will insure that the latch means are completely disengaged thereby permitting the spring force present in the hinge member to swing the upper or top section of the container open thereby exposing the contents of the container held in the lower section.

The container of the present invention may be fabricated from any suitable, flexible, thermoplastic material. Suitable thermoplastic materials are high, medium and low density polyethylene, polypropylene, and copolymers of ethylene and propylene with other comonomers, plasticized PVC and copolymers of vinyl chloride with other comonomers. Any plastic material which is sufficiently flexible to make operable an integrally formed, living hinge, i.e., the hinge can be used in the container of the present invention. The preferred material is polypropylene. The thicknesses of the hinge element and the rear walls and of the container can be readily determined by experiment to provide the proper resistance to application of pressure to insure against accidental opening of the container. Additionally, the thicknesses of these members, together with that of the top member, may be suitably adjusted in order to require the application of a specific number of ounces of compression upon each corner of the container before the latches will release. The container of the present invention may be easily formed by injection molding or by thermoforming suitable plastic material. The container is suitable for packaging medicants in that it can be designed to provide a "childproof" container.

While there has been described what is considered preferred embodiments of the present invention, it is understood that apparatus and design changes may be utilized for constructing and operating the container of the present invention. For example, instead of the latch members utilizing sloping surfaces on their engaging faces, these members may be made in the form of a generally rectangular protrusion whereby a more vigorous and forceful application of pressure will have to be applied to the rear of the top cover of the container in order to release these latch members. The width of the described gaps in the rear of the container, together with the slope of the wall portion of the sidewalls, can be suitably adjusted to provide proper flexing of the top corner areas of the top cover to achieve the proper flexure of the cover to produce the release of the top and bottom portions of the container.

What is claimed is:

1. In an integrally formed, one-piece plastic container the combination comprising:

a. a generally rectangular bottom section having a planar bottom wall, two opposed, upturned sidewalls, and an upturned front wall, all of which are integrally formed and connected to each other, and an upturned back wall integrally formed and connected to said bottom wall;

b. a generally rectangular top section having a planar top wall, two opposed, downturned sidewalls, and a downturned front wall, all of which are integrally formed and connected to each other, and a downturned back wall integrally formed and connected to said top wall;

c. integrally formed hinge means connecting said back wall of said top section to said back wall of said bottom section; and d. said top section adapted to overlie said bottom section and to be frictionally engaged therewith when said container is in the closed position;

wherein both of said back walls are less than one-half the height of the adjacent sidewalls and wherein the upper portion of said back wall of said bottom section terminates short of said sidewalls and the lower portion thereof is integrally connected to said sidewalls of said bottom portion.

2. In the container of claim 1 wherein said hinge means includes a web of plastic material having a thickness of less than one-half the thickness of said back walls.

3. In the container of claim 1 wherein said back wall of said top section terminates short of said sidewalls to provide a slot therebetween.

4. In the container of claim 1 wherein said top and bottom sections are frictionally engaged in the closed position by integrally formed, spaced apart projections provided adjacent the upper edge of the outer wall of said upturned sidewall, which projections are engaged by integrally formed, spaced apart projections provided adjacent the upper edge of the inner wall of said downturned front wall.

* * * * *